US007818843B2

(12) United States Patent
Kinskey et al.

(10) Patent No.: US 7,818,843 B2
(45) Date of Patent: Oct. 26, 2010

(54) MULTI-FUNCTION TOOL APPARATUS AND SYSTEM

(75) Inventors: Terrence P. Kinskey, Alpharetta, GA (US); Matthew G. Williams, Lighthouse Point, FL (US)

(73) Assignee: Union Rich USA LLC, Boca Raton, FL (US)

( * ) Notice: Subject to any disclaimer, the term of this patent is extended or adjusted under 35 U.S.C. 154(b) by 108 days.

(21) Appl. No.: 12/022,623

(22) Filed: Jan. 30, 2008

(65) Prior Publication Data

US 2008/0178393 A1 Jul. 31, 2008

Related U.S. Application Data

(60) Provisional application No. 60/940,849, filed on May 30, 2007, provisional application No. 60/898,357, filed on Jan. 30, 2007.

(51) Int. Cl.
*B25B 15/00* (2006.01)
*B44D 3/16* (2006.01)

(52) U.S. Cl. ..... 7/105; 7/143; 7/165; 7/167; 7/144; 81/439; 15/105

(58) Field of Classification Search ..... 7/105, 7/165, 167, 143, 144, 146, 147; 81/177.4, 81/490, 438, 439; 15/105
See application file for complete search history.

(56) References Cited

U.S. PATENT DOCUMENTS

| | | | | |
|---|---|---|---|---|
| 1,250,328 | A * | 12/1917 | Langford | 81/436 |
| 1,541,078 | A * | 6/1925 | Sudweeks | 30/366 |
| 2,022,775 | A * | 12/1935 | Holland-Letz | 81/439 |
| 5,829,082 | A | 11/1998 | Moreira | |
| 5,956,788 | A | 9/1999 | Henke | |
| 6,009,581 | A | 1/2000 | Davis et al. | |
| 6,272,708 | B1 | 8/2001 | Chen | |
| 6,421,860 | B1 | 7/2002 | Abbott | |
| 7,013,516 | B1 | 3/2006 | Peters | |
| 2004/0163264 | A1 | 8/2004 | Simonz | |

* cited by examiner

*Primary Examiner*—Debra S Meislin
(74) *Attorney, Agent, or Firm*—Novak Druce+Quigg; J. Rodman Steele, Jr.; Gregory M. Lefkowitz

(57) ABSTRACT

A multi-function tool apparatus and system formed from a handle and a utility blade having a structure that facilitates completion of a plurality of functions, thus, reducing the number of ancillary tools required. The handle may include a butt end with a screwdriver in releasable engagement with the handle. The screwdriver can be removed to expose a shaft and several screwdriver bits. The butt end includes a bolt that can be removed to attach and extension pole to allow the apparatus to reach remote areas. The structure of the utility blade allows functions including but not limited to: scraping; putty spreading; caulk stripping; can opening, can closing; roller wiping; cutting; torquing hex nuts on spray guns; nail pulling, nail driving and the like. In other embodiments, other heads may be substituted for the utility blade.

10 Claims, 5 Drawing Sheets

100
506
508
100
504
500
502
120

510
512
514
516
100
504
500
502
120

518
520
522
504
500
502
120

524
526
528
530
532
532
526
504
500
502
120

100
534
504
500
502
120

MULTI-FUNCTION TOOL APPARATUS AND SYSTEM

CROSS REFERENCE TO RELATED APPLICATIONS

This patent application claims the benefit of U.S. Provisional Patent Application No. 60/940,849, filed May 30, 2007 and claims the benefit of U.S. Provisional Patent Application No. 60/898,357, filed Jan. 30, 2007.

BACKGROUND

1. Field of the Invention

The present invention relates generally to the field of tools, and more particularly to a multi-function tool that provides functionality common to painters' needs.

2. Description of the Related Art

Often times, workers such as painters require supporting tools to perform their tasks. In addition to the basic equipment required by a painter, such as a paint brush and paint roller, a painter may require various additional pieces of equipment to perform functions such as scraping, various cutting tasks, spreading, cleaning rollers, scraping caulk, removing lids from paint cans, hammering nails, driving screws and the like. It is appreciated that each of these tasks requires separate tools which can burden the painter.

Therefore, for the foregoing reasons, it is readily apparent that there is a need for a multi-function tool apparatus and system, wherein the present apparatus reduces the number of ancillary tools required by a painter.

SUMMARY

Briefly described in a preferred embodiment, the present invention overcomes the above-mentioned disadvantages and meets the recognized need for such an invention by providing a multi-function tool apparatus and system, comprising a handle and a utility blade having a structure that accommodates a plurality of functions, thus, reducing the number of ancillary tools required by a painter.

According to its major aspects and broadly stated, the present invention in its preferred form is a multi-function tool apparatus and system, comprising a handle having a butt end that includes a screwdriver in threaded engagement with the handle. The screwdriver can preferably be removed to expose a shaft and a plurality of screwdriver bits or varying configuration. The butt end further preferably includes a bolt in threaded engagement with the butt end. The bolt can preferably be removed to attach an extension pole to allow the apparatus to reach remote areas. The structure of the utility blade preferably accommodates functions including but not limited to: scraping; putty spreading; caulk scraping; can opening; roller wiping; cutting; torquing fasteners; nail pulling, nail driving, and the like.

In general, according to one aspect, the invention features a tool apparatus, including a handle, a blade disposed on one end of the handle and a butt end disposed on another end of the handle.

In one embodiment, the butt end comprises a sub-tool inverted to face inwards of a hollow interior of the handle.

In another embodiment, the inverted tool is a screwdriver removably attached to the handle.

In another embodiment, the blade includes a first utility edge.

In another embodiment, the blade includes a second utility edge.

In another embodiment, the apparatus further includes a third utility edge disposed between and generally perpendicular to the first and second utility edges.

In another embodiment, the apparatus includes a tool edge having a paint roller cleaner and a can opener disposed adjacent the paint roller cleaner.

In another embodiment, the apparatus further includes a tool edge having a first hex nut aperture, a second hex nut aperture disposed adjacent the first hex nut aperture, a concave blade edge disposed adjacent the second hex nut aperture and a caulk scraper disposed adjacent the concave blade edge.

In another embodiment, the apparatus further includes a tool edge disposed on one end of the blade, the tool edge including a combination scraper and putty knife, a can opener disposed on one end of the combination scraper and putty knife and a caulk scraper disposed on an end of the combination scraper and putty knife opposite the end having the can opener.

In another embodiment, the apparatus further includes a nail-puller through-hole disposed on the blade.

In another embodiment, the handle includes a central handle portion, a butt portion in threaded engagement with the central handle portion and a bolt end in threaded engagement with the butt portion.

In another embodiment, the bolt end is for hammering.

In still another embodiment, the central handle portion comprises a hollow interior.

In yet another embodiment, the butt portion is a screwdriver handle.

In another embodiment, the apparatus further includes a screwdriver shaft coupled to the screwdriver handle and disposed within the hollow interior of the central handle portion.

In another embodiment, the apparatus further includes screwdriver bits coupled to the screwdriver handle and disposed within the hollow interior of the central handle portion.

In another embodiment, the screwdriver bits are for removeably coupling to the screwdriver shaft.

In another embodiment, the handle is arranged about a longitudinal axis.

In another embodiment, the blade includes three sides.

In another embodiment, a first side of the three sides includes a concave curve, a second side of the three sides includes three concave curves and a third side of the three sides is generally perpendicular to the longitudinal axis.

In another embodiment, two of the concave curves comprise a generally semi-circular profile.

In another embodiment, two of the concave curves include 4 side arranged in a hexagonal pattern.

In another aspect, the invention features a tool system, including a tool handle, a utility blade disposed on one end of the tool handle and an extension pole for affixation to an end of the tool handle opposite the end having the utility blade.

In one embodiment, the system further includes a screwdriver having a screwdriver handle and a shaft coupled to the handle, the screwdriver handle being in threaded engagement with the tool handle, and wherein the shaft is disposed in a hollow interior of the tool handle.

In another embodiment, the extension pole is in threaded engagement with an end of the screwdriver handle.

In another aspect, the invention features a utility tool kit, including a tool apparatus, having a handle and a blade disposed on one end of the handle, a screwdriver for disposition on the handle and an extension pole for disposition on the screwdriver.

In one embodiment, the screwdriver comprises a butt end that is for being in threaded engagement with the handle, while a screwdriver shaft coupled to the butt end is disposed within a hollow interior of the handle.

In another embodiment, the kit further includes an end bolt for being in threaded engagement with the butt end.

In another embodiment, the extension pole includes a threaded end for being in threaded engagement with the butt end when the end bolt is removed from the butt end.

In another aspect, the invention features a painter's tool apparatus, having a handle and a utility knife disposed on the handle and means for performing a painter's function disposed on the utility knife.

In one embodiment, the apparatus further includes a screwdriver disposed on the handle.

In another embodiment, the apparatus can be used to clean a paint roller.

In another embodiment, the apparatus can be used to apply putty.

In another embodiment, the apparatus can be used to scrape.

In another embodiment, the apparatus can be used to scrape caulk.

In another embodiment, the apparatus can be used to cut.

In another embodiment, the apparatus can be used to receive a bolt.

In another embodiment, the apparatus can be used to pull nails.

In another embodiment, the apparatus can be used to open a paint can.

In another embodiment, the apparatus can be used to close a paint can.

In another embodiment, the handle includes a bolt end in threaded engagement with the handle and for hammering nails.

In another aspect, the invention features a tool having a handle and a multi-functional blade connected to one end of the handle, another end of the handle including a threaded opening.

In one embodiment, the blade includes a first edge having a paint roller cleaner aperture, a second edge having a concave cutter, a first hex wrench, and a second hex wrench, a third combination scraper and putty spreading edge disposed between the first and second edges having a first protrusion contiguous with the cutter for scraping caulk and a second protrusion adjacent the paint roller cleaner recess.

In another embodiment, the tool includes a through-hole disposed on the multi-functional blade for pulling nails.

In another embodiment, the tool includes a screwdriver for inserting into a hollow interior of the handle, the screwdriver having a screwdriver handle having adjacent threads for being in threaded engagement with the threaded opening of the handle.

In another embodiment, the tool further includes bolt end having a threaded shaft for being in threaded engagement with a threaded opening disposed on the screwdriver handle.

In another embodiment, the tool includes an elongated extension handle having a threaded end for being in threaded engagement with the threaded opening on the screwdriver handle when the bolt end is removed from the threaded opening on the screwdriver handle.

In another aspect, the invention features method for performing painter's functions, including providing a tool having a handle with a multifunctional blade having a first edge with a concave aperture, a second edge with a concave aperture and a hex profiled aperture, a third straight edge disposed between the first and second edges and having a first protrusion adjacent the first edge and a second protrusion adjacent the second edge, and a through-hole disposed on the multi-functional blade.

In one embodiment, the method further includes inserting a paint roller within the concave aperture on the first edge and running the paint roller along an edge of the concave aperture to clean the paint roller.

In another embodiment, the method further includes spreading putty with the straight edge.

In another embodiment, the method further includes scraping a surface with the straight edge.

In another embodiment, the method further includes scraping caulk with the second protrusion.

In another embodiment, the method further includes removing a lid from a paint can with the first protrusion.

In another embodiment, the method further includes removing a nail with the through-hole.

One advantage of the invention is that it incorporates several ancillary tools into a single tool.

Another advantage of the invention is that it provides a scraping function.

Yet another advantage of the invention is that it provides a spreading function.

Another advantage of the invention is that it provides a lid removal/can opening function.

Still another advantage of the invention is that it provides a caulk scraping function.

Another advantage of the invention is that it provides a hex profile wrench function.

Yet another advantage of the invention is that it provides a cutting function.

Another advantage of the invention is that it provides a paint roller cleaning function.

Still another advantage of the invention is that it provides a hammering function.

Another advantage of the invention is that it provides a screw-driving function.

Yet another advantage of the invention is that it provides a nail-pulling function.

These and other features, objects and advantages of the present invention will become more apparent to one skilled in the art from the following description and claims when read in light of the accompanying drawings.

DETAILED DESCRIPTION

Figure 1:
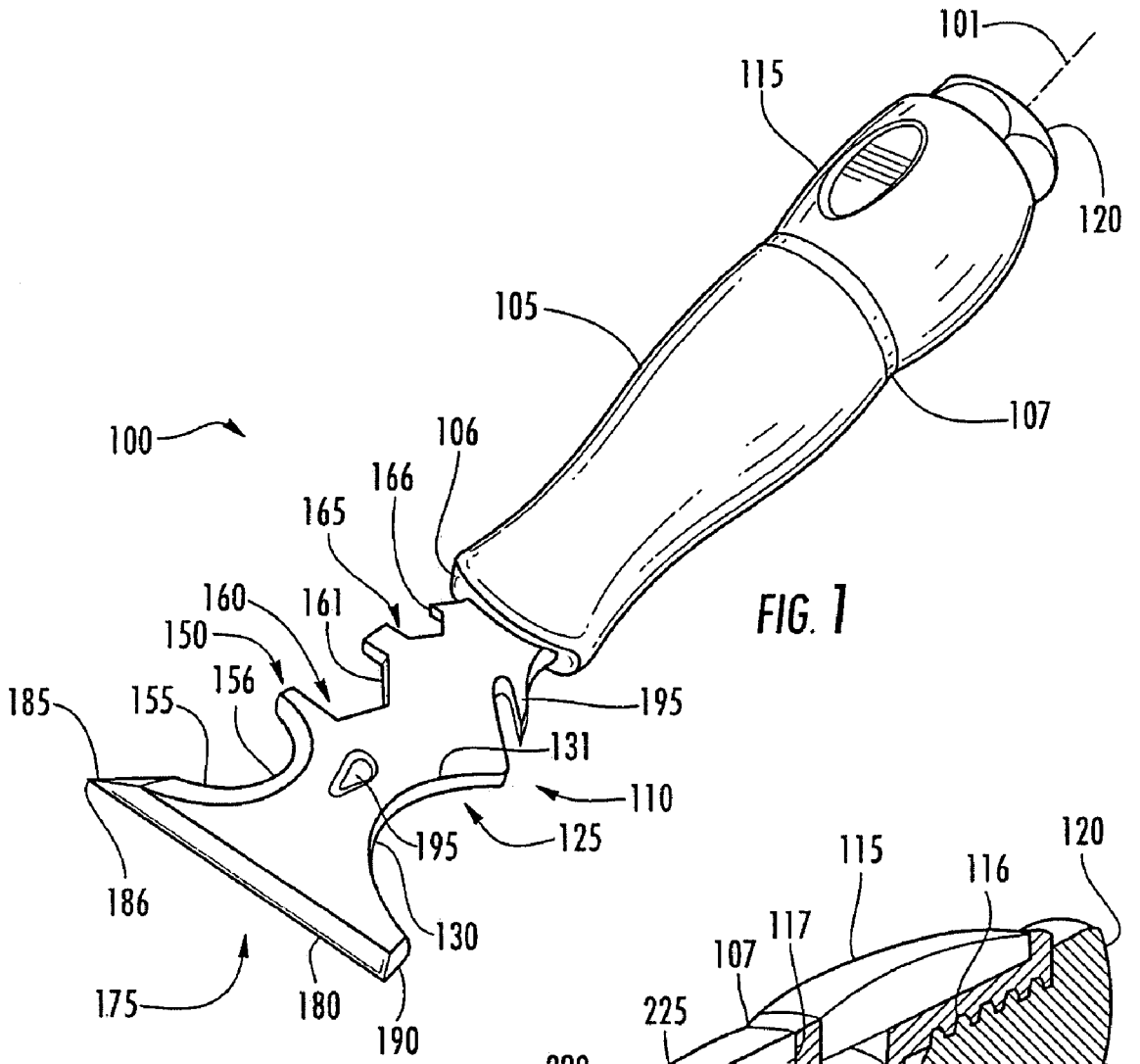
FIG. 1 illustrates a perspective view of an embodiment of a multi-function tool apparatus according to a preferred embodiment of the present invention.

In describing the preferred and selected alternate embodiments of the present invention, as illustrated in FIGS. 1-14, specific terminology is employed for the sake of clarity. The invention, however, is not intended to be limited to the specific terminology so selected, and it is to be understood that each specific element includes all technical equivalents that operate in a similar manner to accomplish similar functions. Moreover, referring to the drawings wherein like reference numerals designate corresponding parts throughout the several figures, reference is made first to FIG. 1 that illustrates a perspective view of an embodiment of a multi-function tool 100, to FIG. 2 that illustrates a perspective cutaway view of an embodiment of a multi-function tool 100, and to FIG. 3 that illustrates a rear perspective view of an embodiment of a multi-function tool system 300, generally illustrating multi-function tool 100, screwdriver 200 and bolt end 120, all discussed in further detail below.

Figure 2:
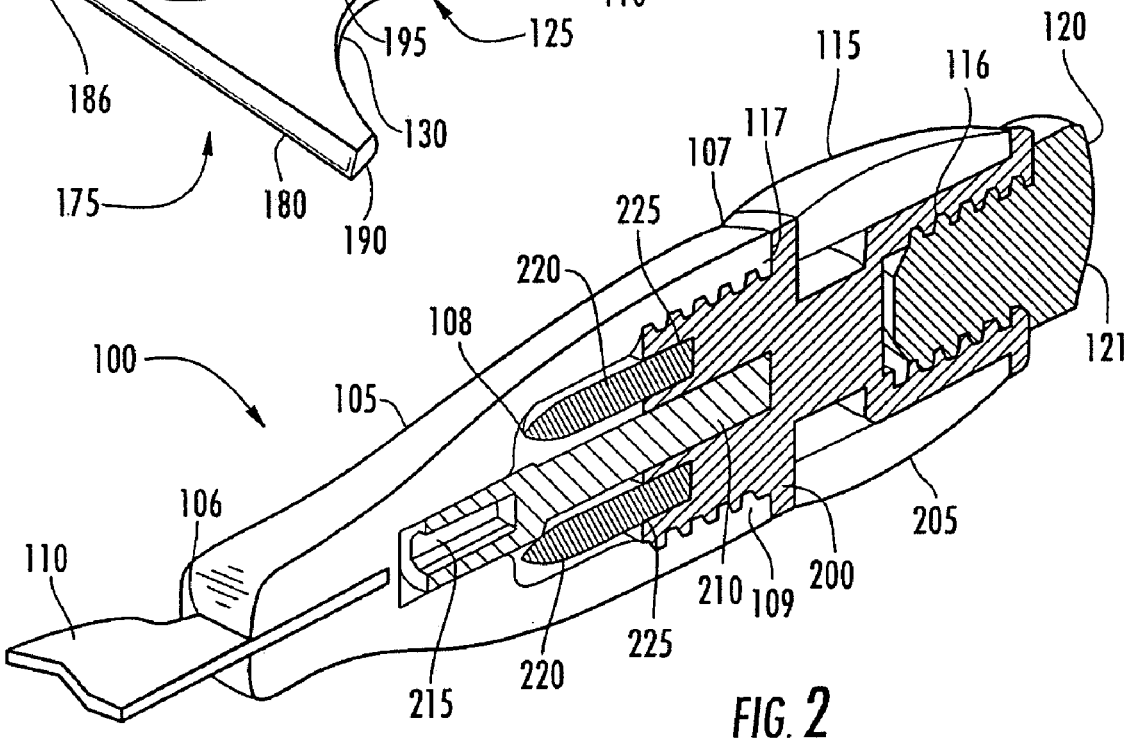
FIG. 2 illustrates a perspective cutaway view of an embodiment of a multi-function tool apparatus according to a preferred embodiment of the present invention.

Now referring to FIG. 1, by way of example, and not limitation, there is illustrated an tool 100 which preferably includes handle 105 having a forward end 106 and a rear end 107. It is appreciated that handle 105 can preferably be formed in any number of shapes and orientations as desired for comfort and/or ease of use, or for aesthetic purposes. In a typical embodiment, handle 105 preferably has a circular cross section tapering slightly from rear end 107 to forward end 106. Handle 105 can also be formed of one or more of a variety of materials with varying gripping characteristics and a variety of textures to aid in gripping. In a typical embodiment, handle 105 preferably includes soft durometer santoprene. Tool 100 preferably further includes blade 110 disposed on one end of handle 105, preferably forward end 106. It is appreciated that blade 110 is preferably attached to forward end 106 so as to provide structural support for blade 110, such as by a tine inserted to a sufficient depth within handle 105. Tool 100 further preferably includes butt end 115, which is preferably in threaded engagement with handle 105, preferably proximate rear end 107. Butt end 115 preferably comprises part of handle 105 when in threaded engagement therewith. Tool 100 further preferably includes bolt end 120 that is preferably in threaded engagement with butt end 115 and is discussed further in the description below. Bolt end 120 preferably includes threads 121 as shown in FIG. 2. Preferably, bolt end 120 is formed of a hard material, such as metal, that can preferably be utilized to drive nails. Typically, a user can use butt end 115 as a hammer to nail nails, such as drywall nails. Butt-end 115 preferably includes internal threads 116, shown in FIG. 2, that preferably engage with bolt end threads 121 to allow butt end 115 and bolt end 120 to be in threaded engagement.

Figures 3, 4:
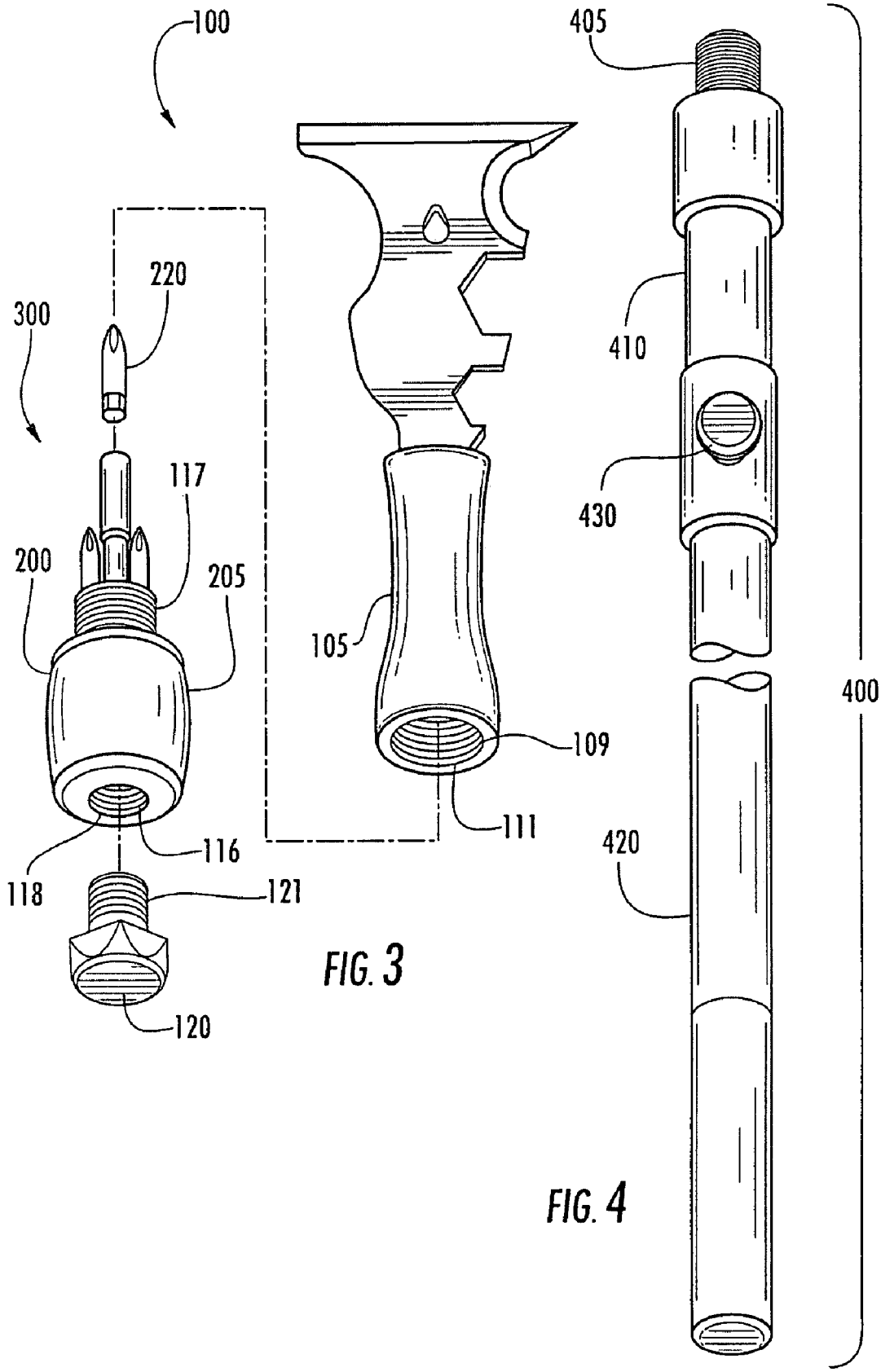
FIG. 3 illustrates an exploded rear perspective view of an embodiment of a multi-function tool system according to a preferred embodiment of the present invention.
FIG. 4 illustrates a rear perspective view of an embodiment of an accessory for the embodiments of the multi-function apparatuses and systems of FIGS. 1-3.

As mentioned above, tool 100 preferably includes butt end 115 that preferably includes sub-tool 200, shown as a cross-section in FIG. 2 and shown as sub-tool 300 in FIG. 3, preferably inverted to face inwards of a hollow interior 108 of handle 105, also shown in FIG. 2. In a typical embodiment, sub-tool 200 preferably includes a screwdriver including handle 205 including butt end 115, as shown in FIG. 2. Sub-tool 200 preferably further includes shaft 210 operably coupled to handle 205. Shaft 210 may include female aperture 215 for receiving one of a plurality of screwdriver bits 220, which can be advantageously stored in a plurality of storage recesses 225, preferably disposed circumferentially about, and adjacent to, shaft 210 and disposed on handle 205. It is appreciated that screwdriver bits 220 can optionally be single or double ended as is known in the art. Screwdriver bits 220 and recess 215 preferably further include cross-sections that allow stable mating so that a torque can be applied to screwdriver bits 220 without screwdriver bits 220 rotating within recess 215. Such a cross-section may optionally be hexagonal but may be other shapes, such as square, diamond, x-shaped, or other. In general, sub-tool 200 preferably includes threads 117 for engagement with internal threads 109 of handle 105, both of which preferably allow butt-end 115 and handle 105 to be in threaded engagement.

Referring still to FIG. 1, blade 110 preferably includes at least three utility edges 125, 150, 175. As further discussed in the description below, the utility edges have a series of shapes and curves that provide a plurality of functions. First utility edge 125 preferably includes at least one concave curve 130 defining an aperture in first utility edge 125. Second utility edge 150 preferably includes at least three concave curves 155, 160, 165, each defining an aperture. Third utility edge 175 is preferably disposed between first and second utility edges 125, 150 and generally perpendicular to, preferably within 15 degrees of perpendicular to, longitudinal axis 101 defined along a length of tool 100. Third utility edge 175 preferably includes at least a portion being straight, and preferably includes two end protrusions 185, 190.

As described above, first utility edge 125 preferably includes concave curve 130 preferably including a circular arc segment profile defining an aperture, and blunt edge 131. Concave curve 130 is preferably adapted to receive a typical paint roller therein for cleaning the paint roller. Concave curve 130 preferably may be used to run blunt edge 131 along a portion of the paint roller to aid in paint extraction, preferably in conjunction with water and soap or other solvents.

As further described above, second utility edge 150 includes three concave curves 155, 160, 165. Concave curve 155 preferably has a circular arc segment profile and sharp edge 156. Concave curve 155 preferably may be used as a cutting edge for a variety of cutting needs, such as cutting natural or synthetic fibers including woven materials, paper, plastic, rubber, wires, wood, or other material.

Concave curves 160, 165 each preferably has a plurality of blunt edges 161, 166 each. In a preferred embodiment, concave curves 160, 165 each has four respective edges 161, 165 that preferably form a portion of a hexagonal profile. It is appreciated that the concave curves 160, 165 therefore are preferably adapted to receive and engage a typical hexagonal nut or other fastener having a similar hexagonal profile, which may, for example, be found on paint sprayers or other devices or containers. Therefore, concave curves 160, 165 may preferably be implemented to loosen or tighten nuts or other fasteners from paint sprayers or other devices or containers.

As also described above, third utility edge 175 preferably includes straight sharp edge 180, which may preferably be used for scraping and/or to apply putty and the like, thereby functioning as a combination scraper and putty knife. First protrusion 185 preferably terminates in point 186, which may preferably be used, for example, as a caulk scraper. In a typical embodiment, first protrusion 185 is preferably contiguous with both straight sharpen edge 180 and cutter edge 156. Second protrusion 190 is preferably formed as a blunt end that may preferably be implemented as a can opener, the cans containing, for example, paint, spackle, stain or the like. It is understood that second protrusion 190 is preferably used to pry tops or lids off cans. The tool 100 may also include a can opener slot 195. The can opener slot 195 may extend into the tool 100 and be positioned distal of the concave curve 130.

Tool 100 further preferably includes through-hole 195 disposed through blade 110. Through-hole 195 may preferably have a variety of shapes and cross sections. As shown in FIG. 1, through-hole 195 preferably has a general tear-shaped profile for advantageously receiving nail heads and is preferably used for pulling nails. Through-hole 195 may include sharpened edges to increase the holding power of the through-hole 195.

It is therefore appreciated that the embodiments of the blade described above have several functions useful to painters including but not limited to: cleaning paint rollers; applying putty and other substances; scraping surfaces; scraping caulk; cutting; driving or loosening threaded fasteners or other devices having hexagonal, or other, patterns; pulling nails; opening cans; driving nails, or the like.

FIG. 4 illustrates a rear perspective view of an embodiment of an accessory for the embodiments of the multi-function apparatuses and systems of FIGS. 1-3. As shown in FIG. 3, tool 100 preferably includes a rear opening 111 preferably including threads 109 to engage with threads 117 of handle 205. Furthermore, handle 205 preferably includes opening 118 preferably including threads 116 to engage with threads 121 of nut end 120. As is appreciated from the Figures, the three components 100, 200, 120 are preferably removable from one another and may optionally be included together as a system/kit 300. FIG. 4 illustrates extension pole 400 preferably having threaded end 405 for engagement with opening 118 and threads 116 when nut end 120 is removed. As such, extension pole 400 may optionally be used to connect to screwdriver 200 alone or to screwdriver 200 in threaded engagement with tool 100. As such, extension pole 400 may preferably be used to reach remote locations where the functionality of tool 100 or screwdriver 200 is required or desired. In a typical embodiment, rod 400 may optionally be combined with other components 100, 200, 120 as a system/kit 300.

Extension pole 400 preferably includes first rod section 410 and second rod section 420 separated by locking button 430. Both sections 410, 420 may preferably be telescopically arranged such that extension pole 400 may be extended and retracted along a spectrum of lengths. Locking button 430 is preferably engaged and disengaged to lock the respective orientation of rod sections 420, 430 into position.

Figures 5, 6, 7, 8, 9:
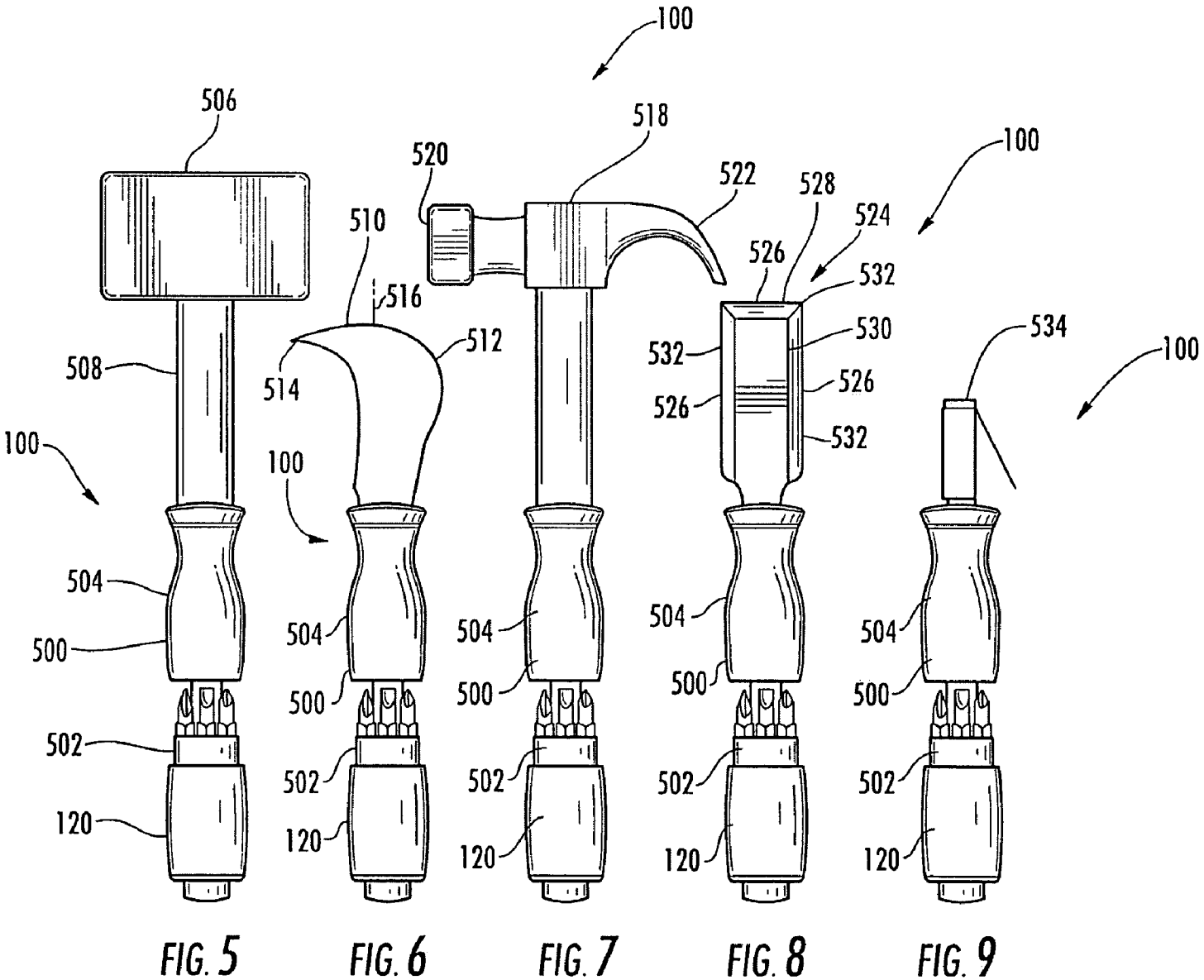
FIG. 5 is a front view of an alternative embodiment of the multi-function tool together with a rubber mallet head.
FIG. 6 is a front view of an alternative embodiment of the multi-function tool together with a flooring knife head.
FIG. 7 is a front view of an alternative embodiment of the multi-function tool together with a hammer head.
FIG. 8 is a front view of an alternative embodiment of the multi-function tool together with a chisel head.
FIG. 9 is a front view of an alternative embodiment of the multi-function tool together with a hex key set head.

In another embodiment, as shown in FIGS. 5-13, the multi-function tool 100 may include a bolt end 120 adapted to receive different heads 500. The bolt end 120 may include a releasable connector 502, which may be, but is not limited to being, threads, a quick disconnect fitting, or other appropriate device. The heads 500 may include handles 504 configured to facilitate easy gripping of the handles 504. The handles 504 may be formed from a rubber or other material. The bolt end 120 may have any appropriate configuration. As previously described, the bolt end 120 may include various screwdriver assemblies. As shown in FIG. 5, the head 500 may include a rubber mallet 506. The rubber mallet 506 may be generally cylindrical and may include be attached to a shaft 508 extending from the handle 504. The rubber mallet 506 maybe formed from any appropriate material. FIG. 6 depicts a head 500 having a flooring knife 510 extending therefrom. The flooring knife 510 may include a curved cutting arris 512 that changes direction in greater than 90 degrees. In addition, the flooring knife 510 may include a point 514 extending generally orthogonally from a longitudinal axis 516. FIG. 7 depicts a head 500 having a hammer 518 extending therefrom. The hammer 518 may include a nail head 520 extending orthogonal from a longitudinal axis 516 of the head 500 and a nail removing claw 522 extending opposite to the nail head 520. The nail removing claw 520 may be have a conventional configuration.

Figures 10, 11, 12, 13:
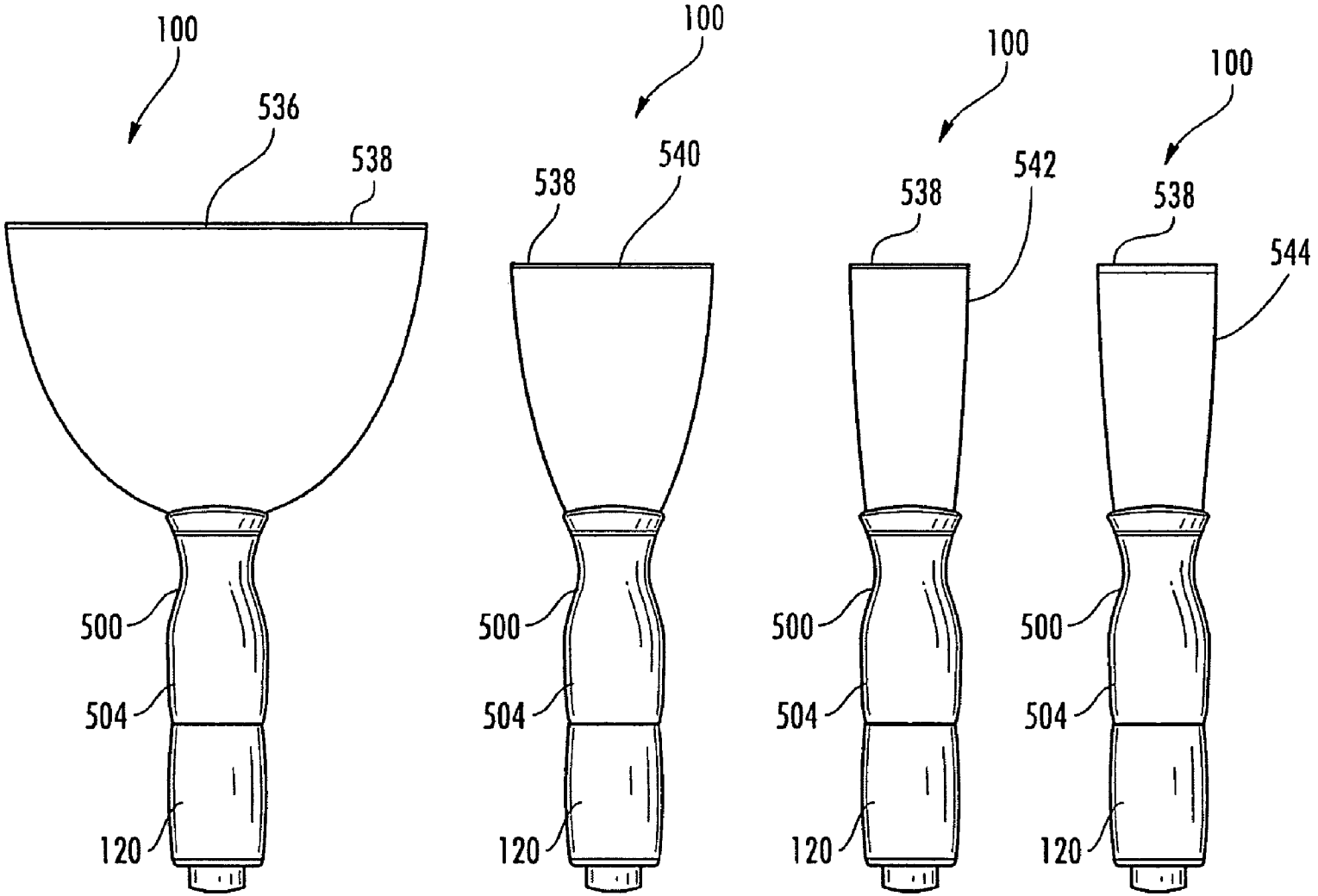
FIG. 10 is a front view of an alternative embodiment of the multi-function tool together with a joint knife head.
FIG. 11 is a front view of an alternative embodiment of the multi-function tool together with a scraper head.
FIG. 12 is a front view of an alternative embodiment of the multi-function tool together with a putty knife head.
FIG. 13 is a front view of an alternative embodiment of the multi-function tool together with a chisel scraper head.
Figure 14:
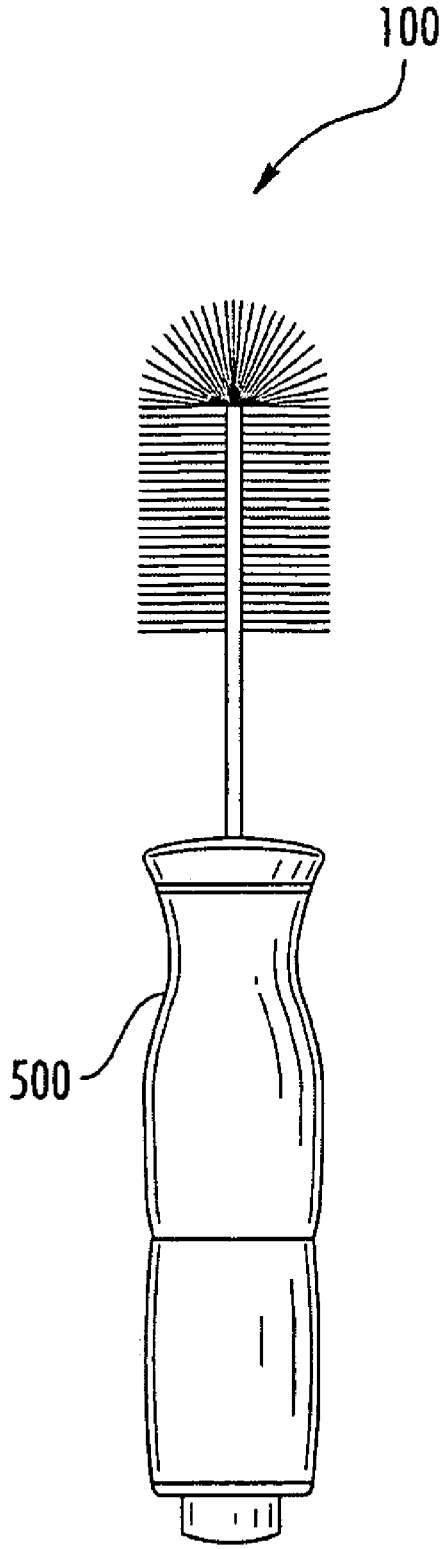
FIG. 14 is a front view of an alternative embodiment of the multi-function together with a wire brush.

FIG. 8 depicts a head 500 having a chisel 524 extending therefrom. The chisel 524 may include a well defined, three sided cutting arris 526. The chisel may be formed from a material having first and second flat sides 528, 530. The cutting arris 526 may be formed from the first flat side 528 and an angled surface 532 extending from the second flat side 530. FIG. 9 depicts a head 500 having a wrench set 534 attached thereto. In at least one embodiment, the wrench set 534 may be a hex key set or other such device. The wrenches may be pivotably coupled to the head 500 enabling the wrenches to be pivoted to be used. FIG. 10 depicts a head 500 having a joint knife 536 extending therefrom. In at least one embodiment, the joint knife 536 may have an outermost edge 538 with a width of about six inches, which may be configured for applying gypsum joint compound to joints between adjacent pieces of gypsum board. FIG. 11 depicts a head 500 having a scraper 540 extending therefrom. The scraper 540 may have an outermost edge 38 having a width of about three inches. FIG. 12 depicts a head 500 having a putty knife 542 extending therefrom. The putty knife 542 may have an outermost edge 38 having a width of about one and one half inches. FIG. 13 depicts a head 500 having a chisel scraper 544. The chisel scraper 544 may be formed from a material that is thicker than the material used to form the putty knife 542. The chisel scraper 544 may include an outermost edge 38 having a width of about one and one half inches. While these heads 500 have been identified as having particular widths, such listed widths are exemplary and not meant to be limiting. FIG. 14 depicts a head 500 formed from a wire brush.

The foregoing description and drawings comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method. Many modifications and other embodiments of the invention will come to mind to one skilled in the art to which this invention pertains having the benefit of the teachings presented in the foregoing descriptions and the associated drawings. Although specific terms may be employed herein, they are used in a generic and descriptive sense only and not for purposes of limitation. Accordingly, the present invention is not limited to the specific embodiments illustrated herein, but is limited only by the following claims.

What is claimed is:

1. A tool, comprising:

a handle with a hollow interior;

a blade disposed on a first end of the handle;

a butt end disposed on a second end of the handle; and a sub-tool contained within the hollow interior of the handle at the butt end;

wherein said blade includes a first utility edge comprising a first hex nut aperture, a second hex nut aperture disposed adjacent the first hex nut aperture, a concave blade edge disposed adjacent the second hex nut aperture, and a caulk scraper disposed adjacent the concave blade edge.

2. The tool as claimed in claim 1, wherein said sub-tool is a screwdriver removal attached to said handle.

3. The tool as claimed in claim 1, wherein said blade further comprises a second utility comprising a concave curve and a can opener; and a third utility edge disposed between said first and second utility edges comprising a combination scraper and putty knife.

4. The tool as claimed in claim 3, wherein said third utility edge is generally perpendicular to a longitudinal axis of said blade.

5. The tool as claimed in claim 1, wherein said blade further includes a nail-puller throughhole disposed on said blade.

6. The tool as claimed in claim 1, wherein said butt end is threadably engaged with the second end of said handle; and the tool further comprising a bolt end threadably engaged with said butt end and configured to be used as a hammer;

wherein said butt end is a screwdriver handle and includes a screwdriver shaft coupled to said screwdriver handle and disposed within said hollow interior of said handle.

7. The tool as claimed in claim 6, wherein said butt end further comprises at least one screwdriver bit coupled to said screwdriver handle and disposed within said hollow interior of said handle.

8. The tool as claimed in claim 1, further comprising an elongated extension handle having a first end for being in removable engagement with an engagement opening on said butt end.

9. The tool as claimed in claim 1, further comprising a driving tool disposed on said handle.

10. A tool, comprising:

a handle with a hollow interior;

a multi-function blade disposed on a first end of the handle;

a butt end disposed on a second end of the handle; and a sub-tool contained within the hollow interior of the handle at the butt end;

wherein said multi-function blade comprises a first edge having a paint roller cleaning recess, a can opener portion, and a can opener slot, a second edge having a concave cutter, a first wrench, and a second wrench, a third edge disposed between said first edge and said second edge having a first protrusion contiguous with said concave cutter at least for scraping caulk and a second protrusion adjacent said paint roller cleaning recess.

* * * * *